United States Patent [19]

Jennings

[11] 4,108,485

[45] Aug. 22, 1978

[54] REDUNDANT LIFT BEAM ASSEMBLY

[75] Inventor: Eugene W. Jennings, Denver, Colo.

[73] Assignee: Stearns-Roger Corporation, Denver, Colo.

[21] Appl. No.: 780,235

[22] Filed: Mar. 22, 1977

[51] Int. Cl.[2] ..... B66C 1/10

[52] U.S. Cl. ..... 294/67 BC; 294/81 R

[58] Field of Search ..... 294/63 R, 67 B, 67 BC, 294/67 BB, 67 DC, 73, 81 R, 81 SF, 90, 106, 110 R, 113

[56] References Cited

U.S. PATENT DOCUMENTS

| | | | |
|---|---|---|---|
| 1,216,291 | 2/1917 | Diescher | 294/67 BC |
| 1,834,499 | 12/1931 | Richter | 294/81 R X |
| 2,087,877 | 7/1937 | Ralston et al. | 294/106 |
| 2,142,232 | 1/1939 | Angstrom et al. | 294/106 |
| 2,384,307 | 9/1945 | Husson et al. | 294/67 BC |
| 3,261,637 | 7/1966 | Bopp et al. | 294/81 SF |
| 3,437,369 | 4/1969 | Gealy | 294/90 X |

*Primary Examiner*—Johnny D. Cherry
*Attorney, Agent, or Firm*—Sheridan, Ross, Fields & McIntosh

[57] ABSTRACT

A lift beam assembly for lifting heavy objects having a main support body and a pair of lift arms pivotally suspended at each end of the body. The free end of each lift arm has an aperture which is sized to fit over and engage lifting trunnions or bosses provided on the object. A latching mechanism is provided for each lift arm whereby through the latching mechanism, each arm can be independently moved from a first outwardly extended, open position to a closed, vertical lifting position. The latching mechanism includes a locking arrangement to hold the lift arms in their desired position. The lift assemblies can be arranged for redundant operation whereby two assemblies are suspended in crossed, perpendicular arrangement from a single lifting hook. An elongated tool is provided for engaging the latching mechanisms so they can be operated from a remote location either above or below the lift assembly.

16 Claims, 6 Drawing Figures

218
216
5
196
62
172
168
174
200
178
208
176
204
202
180
188
158
106
110
100
102
16
112
108
60
160
150
22
206
130
132
12
162
184
210
126
122
128
124
22
164
186
166
190
154
22
182
104
152
220
198
72
74
24
156
5
146
140
26
142
136
144
76
138
14
134
30
48
90
46
28
82
52
94
50
222
34
32

226
224

228

REDUNDANT LIFT BEAM ASSEMBLY

BACKGROUND OF THE INVENTION

This invention is directed to a lift beam assembly for attaching to and moving relatively heavy objects. It is more specifically directed to a redundant lift beam assembly incorporating mechanical latching mechanisms to outwardly extend and retract the lift arms from a relatively remote location.

In the past it has been common practice to utilize a pair or series of hook-like members which are suspended from each end of a laterally transverse beam. The beam usually has a ring attached near its mid-point so that the beam can be attached to and lifted by a crane hook. It was necessary, especially when lifting a heavy object, such as a vessel, cask or ladel, to move the beam and its associated hooks transversely across the object so that the beam and hooks can straddle and engage a pair of trunnions diametrically mounted on the sides of the vessel. Once the hooks were engaged, the beam could be raised so as to lift the vessel.

One of the major problems encountered with this type of arrangement is the necessity for a relatively large clear area along the side of the object to provide clearance for the movement of the crane to position the lift beam and hooks for engagement with the trunnions. Another problem was to prevent the hooks from disengaging. To resolve this problem, it was sometimes necessary for an operator to manually install a cross member to close the opening in the hooks to prevent their disengagement.

The hook arrangement had distinct limitations when it was necessary to provide redundant capabilities for safety purposes. This is especially true in the nuclear industry where safety is of paramount importance. Where it is necessary to lift a vessel or cask at four equally spaced points, the lift beam-hook arrangement is limited due to the fact that it is necessary to move the lifting assembly sequentially through two perpendicular directions to engage all of the conventional hooks.

The basic lifting assemblies used in the past have followed the design described above. When it was necessary to provide a specialty arrangement for hoisting heavy or bulky objects, various modifications have been suggested. One of these is described in U.S. Pat. No. 3,304,115 issued to W. B. Brooks et al. The lifting apparatus described in this patent is specifically designed for transferring a heavy load from an overhead crane to a front loading lift truck. This device provides a double beam assembly which is arranged in series to lift a heavy object such as a rocket motor. In use, an overhead crane engages the upper lift assembly which supports a lower or second lift assembly which is in turn attached by means of links to the object. When the lift truck engages the lower lifting assembly, the upward movement causes the ends of the links of the upper assembly to slide along the surfaces of a pair of outwardly sloped plates. This movement causes the upper links to spread so as to disengage the trunnions on the lower beam assembly.

In a similar way, U.S. Pat. No. 3,297,353, issued to Carlson, shows a truss assembly containing three scissor tongs spaced equally and arranged to engage the upper edge of a large concrete drainage pipe. After positioning the tongs over the edge of the pipe, upward force on the center of the assembly causes the tongs to close, gripping the pipe so that it may be raised and moved.

This assembly shows the use of mechanical levers to perform the gripping operation and is typical of the lever approach for solving a lifting problem.

Another lifting assembly is disclosed in U.S. Pat. No. 3,287,057, issued to Gallapoo, which is used for lifting coils of sheet metal or the like. In this arrangement, the transverse beam has a pair of gripping jaws positioned at each end of the beam. The upward movement of the beam assembly causes the retraction of the jaws longitudinally with respect to the beam causing the jaws to grip the object along its sides. This gripping action is also reversed by the removal of the upward supporting force causing the jaws to extend and release their load.

None of these devices or any other known in the prior art provides a single fool-proof arrangement for engaging a heavy object when the object is surrounded and side clearance is restricted. This situation occurs quite often in the electrical or energy generating industry and especially in nuclear power plants. Because of the shielding requirements, heavy vessels for the reactors and casks containing radioactive materials are necessarily located in pits or water filled tanks which provide minimal side clearance around the vessel.

Another major problem especially prevalent in the nuclear industry is the manifest requirement for safety. The lifting and movement of objects, more especially heavy objects, presents problems which prior art devices can not effectively solve. Because of the catastrophic results that could occur upon the accidental failure of a lifting assembly and the dropping of a vessel, it is absolutely necessary that any lifting device which is directed to the side clearance engagement problem must also provide a high factor of safety during usage.

It is therefore an object of the present invention to provide a redundant lift beam assembly which can be used to engage and lift extremely heavy objects and to engage these objects even where there is limited side or lateral clearance.

It is a further object of the present invention to provide a redundant lift beam assembly which provides a substantial factor of safety to adequately and safely handle heavy objects containing hazardous or dangerous materials.

It is a still further object of the present invention to provide a lift beam assembly having a simple mechanical mechanism for outwardly extending and retracting lift arms in order to quickly and easily engage and release lifting trunnions.

It is a still further object of the present invention to provide a lifting assembly which is extremely foolproof in operation without the requirement for auxiliary equipment to provide a pressurized source of actuating power which is needed in all hydraulic or pneumatic systems.

It is a still further object of the present invention to provide a lift beam assembly which can be easily constructed and inexpensive to manufacture and yet has the strength capabilities to lift and move extremely heavy objects.

An additional object of the present invention is to provide a lift beam assembly in which the actuating latching mechanisms are capable of being operated by an individual from a remote location either above or below the lift assembly.

SUMMARY OF THE INVENTION

A redundant lift beam assembly which is capable of lifting a relatively heavy object is provided having a pair of lifting assemblies suspended in crossed relationship.

Each assembly has an elongated structural support body and two vertically suspended lifting arms pivotally mounted, one at each end of the body. A mechanical latching mechanism is provided independently for each lifting arm. The latching mechanism includes a right angle pivotally mounted lever connected at one end with an upper extension of the lifting arm. The opposite end of the lever interconnects a vertically positioned slide rod which is guided within apertures provided in the supporting body. Eyelets are provided at both the top and bottom of the slide rod for the engagement of a hook-like elongated tool for actuating the mechanism from a remote location either above or below the support body. A locking mechanism consisting of a transverse key and cooperating key way in conjunction with a biasing spring is provided on the slide rod whereby the desired position of the associated lifting arm can be retained.

Each lifting arm, by the above described mechanism, can be pivotally moved from a first or open position whereby the lifting arm is extended outward in a longitudinal direction from the body in order to provide clearance beyond the end of a lifting trunnion or other coupling device on the object. By rotating the slide rod to disengage the key lock, the rod can be slidably moved causing the lever and lifting arm to pivot downward to a vertical position so that the arm and its associated coupling aperture engage the lifting trunnion. This second position is also called the closing or lifting position.

The lifting mechanism as described herein is arranged at each end of the lifting body whereby a corresponding lifting arm can be individually operated to position the assembly over a pair of trunnions on opposite sides of the vessel or heavy object.

In the present invention, the lift assemblies are arranged so that they can be used in redundant operation. Thus, two lifting assemblies are attached to a single crane hook and preferably situated so that they are positioned 90° to each other. The lengths of the lifting arms of the attached assemblies are arranged so that the coupling apertures in the free ends of the lifting arms all lie in a common plane so that they will align with trunnions or lifting posts on the sides of the vessel. Thus, with the two lifting assemblies properly attached to the crane hook, the redundant unit can be positioned over the vessel with the lifting arms moved to the closed position over the trunnions. In this way the vessel can be raised and moved with a considerable degree of safety to minimize any possibility of accidents.

It is an important feature of the present invention that the latching mechanisms be capable of operating mechanically without the necessity for the provision of an auxiliary power source which is common in hydraulic or pneumatic systems. In other words, a simple and easy operating mechanism is provided which is essentially fool proof and readily operated when needed.

BRIEF DESCRIPTION OF THE DRAWINGS

Other features of this invention will appear in the following description and appended claims, reference being made to the accompanying drawings forming a part of the specification wherein like reference characters designate corresponding parts in the several views.

DETAILED DESCRIPTION OF EMBODIMENTS

Figure 1:
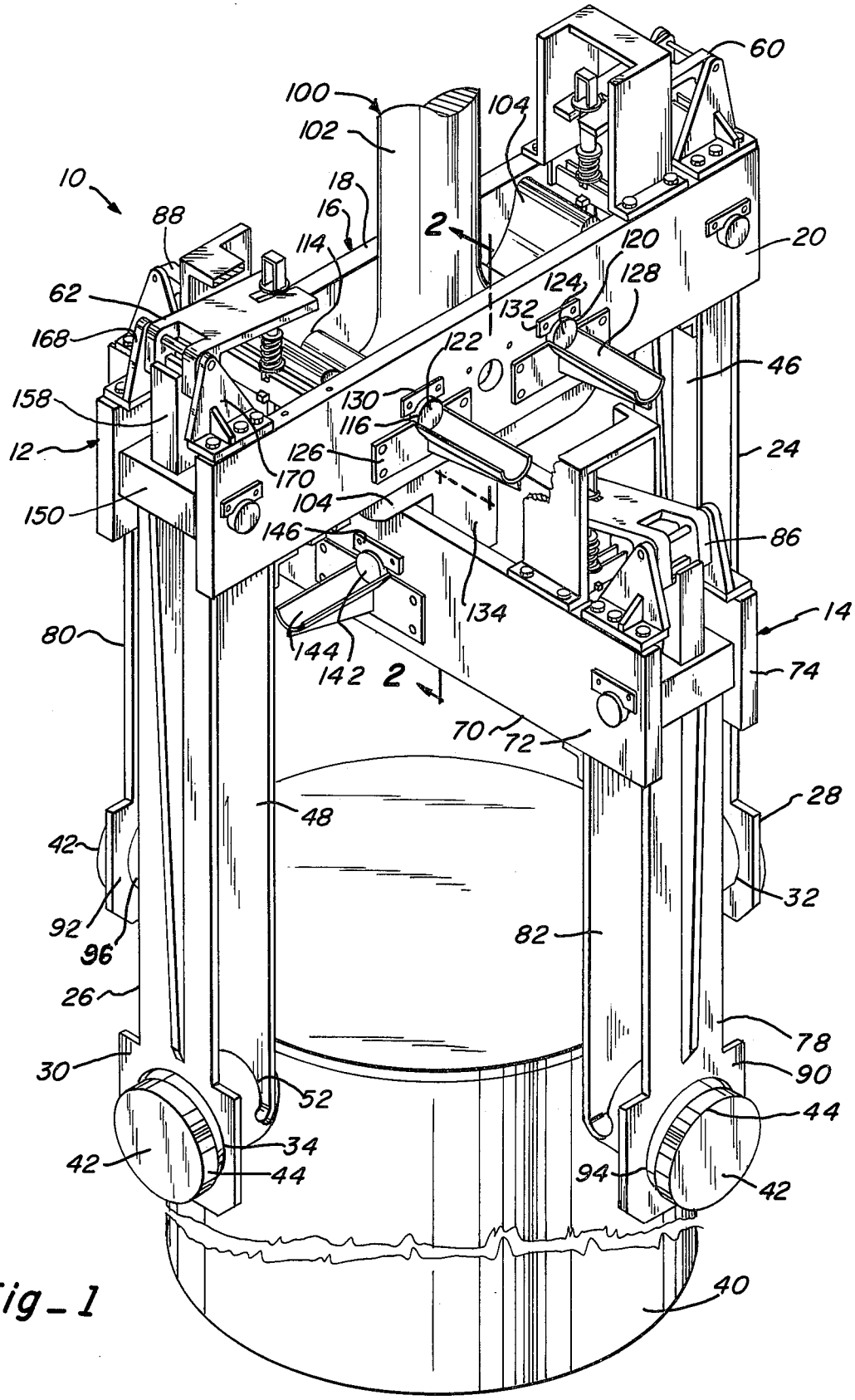
FIG. 1 is a perspective view of a redundant lift beam assembly according to the present invention which is shown in the trunnion engagement position and ready for lifting.

Turning now to the drawings, FIG. 1 shows the redundant lift beam assembly 10 according to the present invention, which includes the upper beam assembly 12 and the lower beam assembly 14.

The upper beam assembly 12 has a transverse body 16 formed by a pair of relatively thick plates 18 and 20 which are joined together by a plurality of cross members 22 which hold the plates in spaced parallel relationship. A pair of lifting arms 24, 26 are pivotally suspended at each end of the transverse body 16. Coupling plates 28, 30 are fixedly attached to the bottom edges of the lift arms 24, 26 respectively. Large apertures 32, 34 are provided in the coupling plates 28, 30.

A large heavy object or vessel 40 having diametrically opposed lifting bosses or trunnions 42 is illustrated and represented in FIG. 1. Each trunnion 42 can have an enlarged shoulder 44 which is common for this type of lifting arrangement and prevents the lifting attachment from slipping off during the lifting or moving operation. It is to be understood that throughout this specification it is possible to substitute any type of suitable arrangement for coupling the lifting arms to the object. One such arrangement could be the attachment of the trunnions or a pin like boss to the inside faces of the lifting arms and providing corresponding apertures in the side walls of the object.

The apertures 32, 34 provided in the coupling plates 28, 30 are sized to easily fit over the shoulders 44 on the trunnions 42. Guide plates 46, 48 are mounted under the support body and are spaced inwardly from the lifting arms 24, 26. These guide plates 46, 48 have open ended slots 50, 52 provided at their bottom edges which allows the lift beam assembly to be easily and properly positioned with respect to the vessel trunnions so that the lift arms and coupling plate apertures will properly engage the trunnions.

The lift arms 24, 26 are movably actuated by the latching mechanism 60, 62, respectively, which are mounted on the upper edges of the lift beam body 16. The latching mechanisms 60, 62 cause the lift arms 24, 26 to move from a vertically downward suspended position for lifting a heavy object, such as vessel 40, to an outwardly extended or open position whereby the coupling plates 28, 30 and their respective apertures are moved outwardly to clear the ends of the trunnions 42.

The lower lift beam assembly 14 includes the elongated, body 70 which has a pair of relatively thick beam plates 72, 74 which are held in parallel spaced relationship by cross members 76. A pair of lift arms 78, 80 are each pivotally suspended at the ends of the body 70. In addition, a pair of guide plates 82, 84 (not shown) are also positioned inwardly on the body 70 adjacent to the lift arms 78, 80 respectively. Latching mechanisms 86, 88 which are attached respectively to lift arms 78, 80, are also provided on the lift beam body 70 similar to the arrangement described above for the upper lift assembly. In addition, coupling plates 90, 92 are fixedly attached to the bottom ends of the lift arms 78, 80 and each has an aperture 94, 96 which is sized to conveniently fit over the trunnions 42.

The upper lift beam assembly 12 and the lower lift beam assembly 14, in order to provide the redundant safety features required in certain types of operations, are joined together in an "X" or cross configuration and are supported by an overhead crane hook assembly 100. The crane hook assembly 100 includes the upwardly extending shank 102 and double sided hook 104. The hook 104 has upwardly extending side edges 106, 108, which form hook depressions 110, 112. A pair of oppositely aligned holes 114, 116 are provided near the mid-point of the plates 18, 20. A second pair of aligned holes 118, 120 are provided also near the mid-point of the plates 18, 20 but spaced longitudinally. These holes are sized to receive pins 122, 124, respectively, and are arranged to correspond with the depressions 110, 112 provided in the double hook 104. Pin support brackets 126, 128 are provided and aligned with the outer edges of the holes 116, 120 on the outer side of the plate 20 for supporting the pins 122, 124 when they are not in the hook engaging or lifting position. Pin keepers 130 and 132 are bolted to the sides of the plate 20 and engage a slot provided near the outer edge of the pins 122 and 124 to retain the pins in position while the double hook 104 is engaged.

A downwardly projecting hook extension 134 is provided below the double hook 104 and has a sufficient width to pass between the plates 72, 74 of the lower beam assembly 14. A transverse aperture 136 is provided through the extension 134 to receive a connecting pin 142. A pair of aligned holes 138, 140 are provided through the mid-point of plates 72, 74, respectively, to receive the connecting pin 142. A pin support bracket 144 is mounted on the outer surface of the plate 72 for retaining the pin when it is not in the lifting position. A pin keeper 146 which can be bolted to the outer surface of the plate 72 engages a slot provided near the outer end of the pin 142 to retain the pin in its proper position during the lifting operation.

The lower hook extension 134 is arranged in conjunction with the hook assembly 100 so that it is positioned 90° or perpendicular to the plane of the double hook 104. Thus, with the overhead crane hook assembly 100 attached to and supporting the upper and lower lift beam assemblies, the lower beam assembly is held in a position which is perpendicular or 90° with the upper assembly and the center point of the lift beams coincide so that the ends of the beam bodies extend outwardly an equal distance. As can be easily seen in FIG. 1, the usual arrangement of the trunnions 42 is equally spaced around the perimeter of the vessel 40 wherein each opposite pair of trunnions is arranged in a plane which is 90° to the other pair. In addition, the trunnions are arranged so that they all lie in a common horizontal plane.

One of the major differences between the upper and lower beam lift assemblies is the length of the corresponding lift arms. The upper beam assembly lift arms 24, 26 are longer than the lower beam lift arms to compensate for the differences in elevation of the beam bodies 16 and 70. Thus, the apertures 32, 34 and 94, 96 provided in the lift arm coupling members are the same diameter and the center of these apertures lie in a common horizontal plane. Where there is a discrepancy in the vertical positioning of the center lines of the apertures 94, 96 with respect to the apertures 32, 34, a vertical adjustment can be provided in the hook extension 134. Thus, the hook extension 134 can be moved either up or down with respect to the double hook 104 to compensate and correct for discrepancies in the center line position of the apertures. With the coupling plates engaging the trunnions of the vessel equal lifting stress is distributed to each of the lifting arms during any lifting operation.

It is to be understood that the redundant lift beam arrangement is provided for the additional safety required in certain industries. It is, however, possible that the lift beam assemblies can be used separately as individual lifting assemblies without the redundant arrangement as described above. Thus, a single lift beam assembly can be used with its pair of lifting arms in order to engage trunnions which are placed diametrically across the vessel and for lifting the vessel or object as required where safety is not a controlling factor.

The operation of the lift arms in their movement from the lifting position to the open position and the latching mechanism for performing this movement is of major importance in this invention. For the sake of illustration and due to the fact that the mechanisms are the same for each lift arm, the lifting mechanism 62 which is provided for the upper lifting assembly 12, will be described herein. This particular mechanism is shown in the left hand portion of FIG. 2 and will be described in more detail. It must be understood, however, that any reference to this particular mechanism can be applied correspondingly to any of the other mechanisms provided in the redundant lift beam assembly.

The lift arm 26 includes a widened base or bearing section 150 to which is affixed, such as by welding, a downwardly extending elongated flat plate 152. This flat plate is reinforced by front and back ribs 154 and 156 which are welded to the plate 152 near its center line to provide rigidity and prevent bending. The coupling plate 30 having the aperture 34 is permanently attached to the bottom edge of the flat arm plate 152. This connection can be performed by welding or any other arrangement so long as a strong permanent joint is provided which is capable of withstanding the lifting stress transmitted through this joint to the arm pivot.

Extending upwardly from the base section 150 is a short, upper arm portion 158 which is slightly offset outwardly from the plane of the lower arm plate 152. A reinforcing rib 160 is provided to add additional rigidity to the upper arm 158 because of the bending forces involved. A bearing sleeve 162, formed from a suitable material such as bronze, is sized to fit a bore 164 provided transversely through the base section 150. A wrist pin 166 positioned within the bearing sleeve 162 pivotally suspends the lift arm 26 from a pair of aligned holes provided in the body plates 18, 20 of the lift beam assembly.

A pair of triangular support brackets 168 and 170 are mounted to the upper surfaces of the body plates 18, 20 by suitable fasteners such as bolts. A right angle lever 172, having an elongated arm 174 and short bifurcated end 176 is pivotally mounted between the brackets 168, 170 by pin 178. A second pin 180 extends inwardly between the bifurcated ends 176 of the right angle lever 172. The second pin 180 engages an open ended slot provided in the short extension 158 of the arm 26. The end of the elongated section 174 of the right angle lever 172 is slotted to receive the actuating rod 182.

Figure 5:
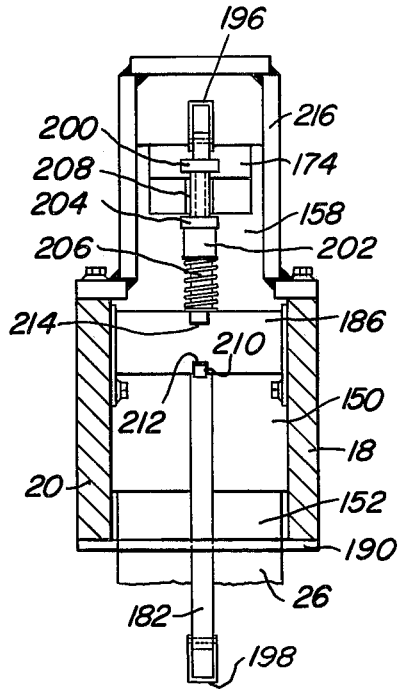
FIG. 5 is a partial section view taken along the lines of 5—5 of FIG. 2 showing the spring biased locking mechanism for the actuation rod portion of the latching mechanism.
Figure 6:
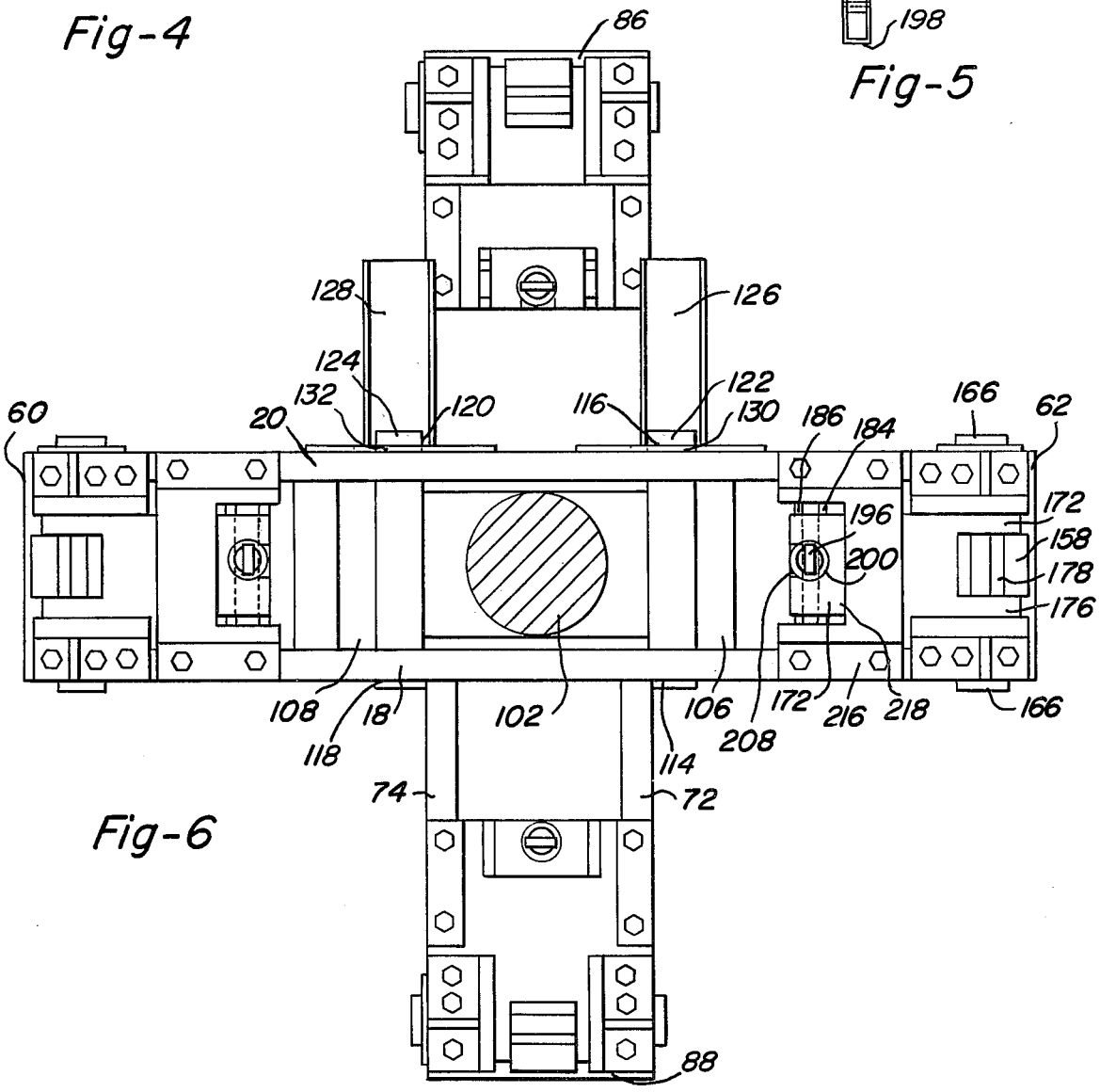
FIG. 6 shows a top plan view of a redundant lift beam assembly according to the present invention.

A pair of cross guide supports 184, 186 are spaced apart and attached at their ends to the inside surfaces of the beams 18, 20. A bore 188 is vertically formed through the spaced supports 184, 186 and is sized to slidably receive the actuating rod 182. A lower guide plate 190 having a bore to receive the lower end of the actuating rod 182 is provided across the bottom surfaces of the plates 18, 20. An upper and lower notch 214, 212 (see FIG. 5) are provided transversely across the supports 184, 186 and are aligned with the bore 188 provided for the actuating rod 182. A pair of loops or eyelets 196, 198 are provided at each end of the slide rod 182 and are rigidly attached to extend longitudinally outward from the ends of the rod 182.

The upper eyelet 196, has a collar 200. Spaced below the collar 200 is a sleeve 202 having a collar 204 at its upper end. The sleeve 202 is rigidly attached to the slide rod 182 by a set screw or pin to hold it in proper position. A helical compression spring 206 is provided between the sleeve 202 and the top surface of the cross members 184, 186 to properly bias the rod 182 when it is in the lowered position. Flat washers are provided at the top and bottom of the spring 206 to properly retain the ends during actuation.

The elongated portion 174 of the right angle lever 172 has an open slot 208 which is sized to receive the slide rod 182. The sleeve 202 is positioned on the slide rod 182 so that the collar 204 is spaced from the upper collar 200 to allow clearance and movement of the lever 172 during actuation.

A locking key 210, which can have a circular or rectangular cross section, is positioned through a transverse aperture in the rod 182. The key 210 is arranged so that the ends project outwardly on either side of the rod 182 a sufficient distance to overlap the width of the cross members 184, 186. The width of the key 210 is designed to be slightly less than the space between the cross members 184, 186 so that it can easily pass through the space between these members. When the key is in a locking position, it is positioned cross-wise to the members 184, 186 and is retained either in the lower notch 212 or the upper notch 214 depending upon the position of the lift arms.

In order to protect the mechanism especially in the region of the eyelet 196 and the slide rod 182, a rigid, U-shaped guard 216 is bolted to the upper surfaces of the plates 18, 20. A notch or cut-out 218 is provided in the upper surface of the guard 216 to provide clear access to the eyelet 196. This guard protects the mechanism from damage especially from the crane hook assembly 100 when the hook is moved into position for engaging the lift beam assembly.

A lift arm guide plate 48 is suspended from the under side of the plates 18, 20 by attachment to the angle 220 which is welded or joined to the cross member 22. The tip ends 222 of the guide plate 48 are bent outwardly so that in cooperation with the other corresponding guide plates, the assembly can essentially position itself over the surface of the vessel as the lift assembly is lowered into position.

Figures 2, 3:
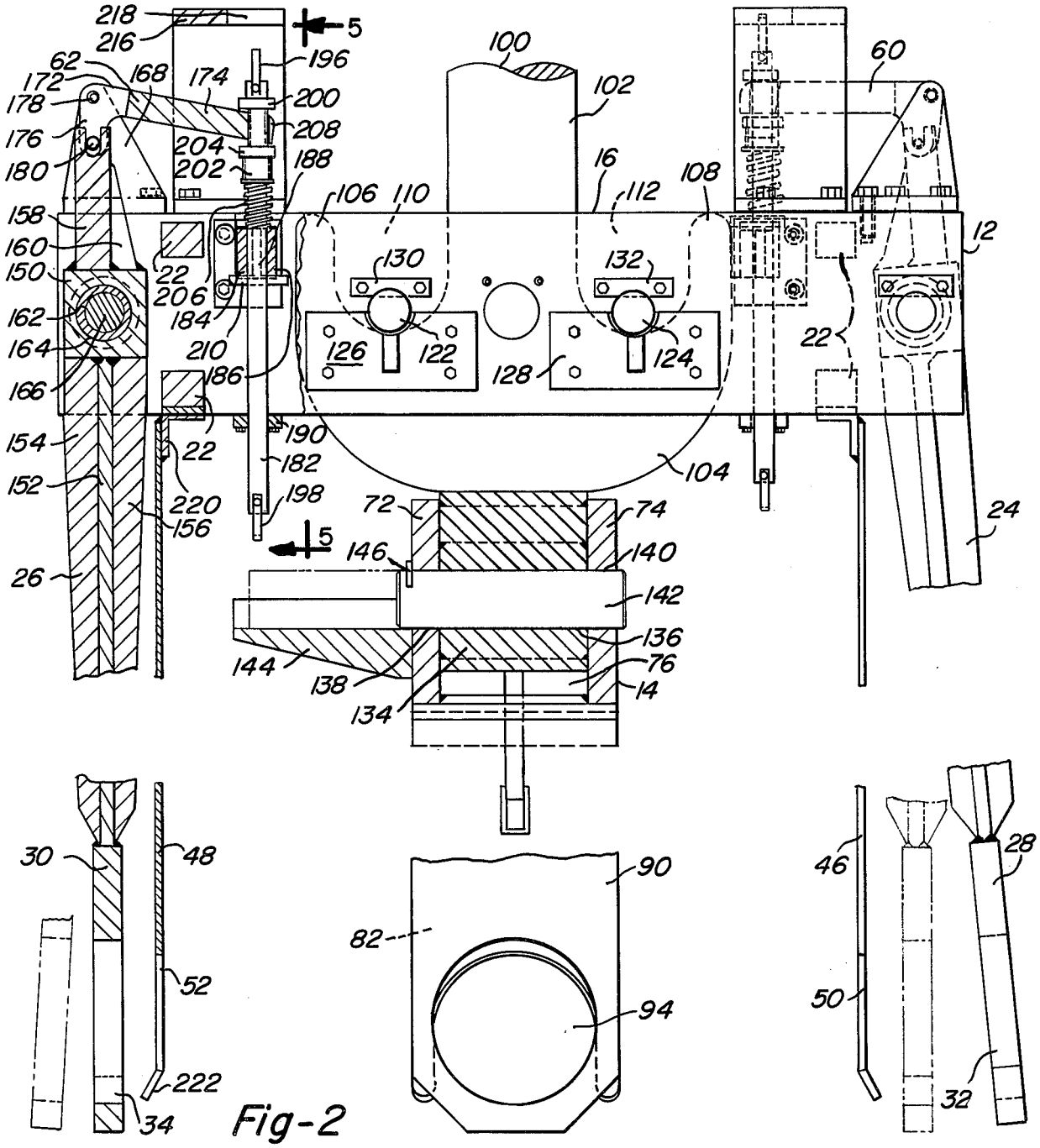
FIG. 2 is a side elevation view taken along the lines 2—2 of FIG. 1, showing the latching mechanisms for extending or lowering the lifting arms with the mechanism on the left side shown in partial section view.
FIG. 3 is a perspective view of a hook-type tool which can be used for actuating the lift arm latching mechanism.
Figure 4:
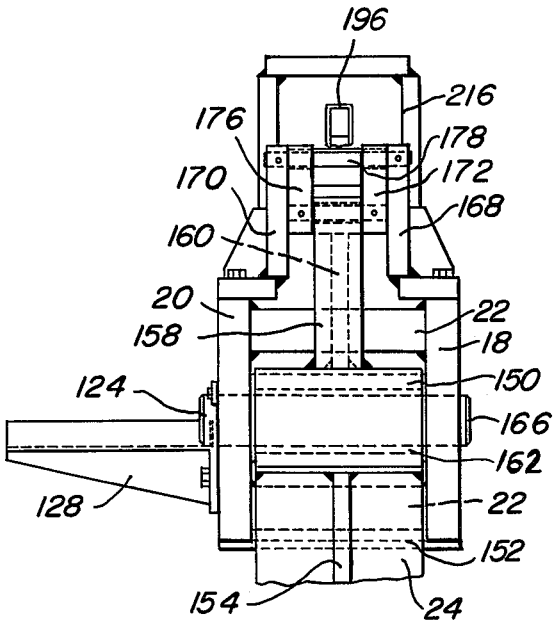
FIG. 4 is a partial side elevation view showing the pivotal mounting of the lift arm and the right angle lever which is part of the latching mechanism.

In FIG. 2, the lift arm 26 is in the vertical or closed position for lifting objects. The slide rod 182 is in the bottom or lowered position with the key 210 retained in the lower slot 212. The spring 206 is held in a compressed state between the sleeve 202 and the top surface of the cross members 184, 186, locking the key in position. In this way, the lift arm 26 and the coupling plate 30 are locked in the vertical position with the aperture 34 positioned over the trunnion of the vessel.

When it is desired to open or extend the lift arm 26 the hook 228 of the tool 224 is inserted in the opening of the eyelet 198 and the rod 182 is pulled downwardly slightly to remove the key from the retaining notch. While held in this position, the rod 182 is rotated 90° in either direction so that the key 210 aligns with the space between the cross members 184, 186. Once this is accomplished, the rod is moved upwardly with the aid of the spring 206 which causes the lever 172 to rotate counterclockwise as seen in FIG. 2 causing the lifting arm 26 to rotate and move outwardly into the extended or open position shown in dotted lines. Once the lift arm 26 is located in this position, the slide rod 182 is again rotated 90° so that the key 210 is again positioned cross-wise to the members 184, 186 and rests in the notch 214. The weight of the arm 26 will hold the key 210 in the notch 214.

Conversely, when it is desired to move the lift arm 26 to the closed or lifting position, the reverse operation is performed with the slide rod moved downward against the spring tension 206 and the key 210 moved to the bottom notch 212.

The mechanism 60 and lift arm 24, shown in FIG. 2, is illustrated in the open position and shows the relative position of the mechanism components. As can be seen, the biasing spring is released with the weight of the lift arm holding the key in the upper locked position.

For the purposes of storage, stands having sufficient strength can be provided for suspending and supporting the individual lift beam assemblies above the surface of the floor. This allows the latching mechanisms to be checked prior to use and conveniently positions the assemblies for attachment to a crane hook.

When the redundant lift beam assembly 10 is prepared for use, the overhead crane assembly 100 is moved into position first with respect to the upper lift beam assembly 12 and the pins 122, 124 are properly installed and secured. The crane hook assembly is then raised lifting the upper assembly 12 free of its support stands. The hook assembly 100 and the upper lift beam assembly 12 is then lowered into position over the lower lift beam assembly 14. With the lower lift beam assembly 14 in a position 90° to the upper beam assembly, the pin 142 is installed and secured. Thus, with the lift beams rigidly attached, the redundant lift beam is assembled and ready for use.

OPERATION

When it is desired to use the redundant lift beam assembly according to the present invention, the following sequence is generally performed. With the lift assembly suspended above the floor by the crane, an operator actuates the latching mechanisms in order to position all of the lift arms in the extended or open position. The assembly is then positioned directly over the vessel with the lift arm guides generally aligned with the trunnions. Upon lowering the assembly over the vessel, the guides and their lower slots align the assembly with respect to the lifting trunnions and lowering continues until the guides contact the trunnions and substantially support the lift assembly. Once in this position, the operator individually actuates each of the latching mechanisms by use of the elongated tool so that the lift arms are moved to the closed or lifting position and locked in place. Upper movement of the crane hook assembly 100 causes an equal lifting force to be applied to all four lifting arms providing an easy and safe lifting operation for the relatively heavy vessel and its contents.

Upon relocating the vessel, the weight on the lift beam assembly is relaxed so that the slotted guide plates again engage the trunnions. Once in this condition, the operator, by use of the elongated hooked tool, actuates the individual latching mechanisms to again open the lifting arms so that they are free of the individual trunnions. The lift beam assembly, thus, can be moved to another location for further use.

The components of the redundant lift beam assembly, described herein, can be fabricated from any suitable material which will provide the desired strength characteristics. Dimensions of the components are determined primarily from the lifting capacity and factor of safety required for the assembly and the maximum sizes of the vessels or objects that are to be moved.

The remote operating and mechanical latching feature of the present invention is of importance in that no additional outside source of power such as hydraulic or pneumatic is required for efficient operation of the lift assembly. Thus, a fool-proof mechanism is provided which can be operated simply by an operator from a relatively remote position. Where the vessel is in a relatively inaccessible position, such as submerged in a tank of water which is common in a nuclear power plant, the operator can be as far as thirty feet or more above the vessel and lift assembly and still effectively operate the mechanism in a relatively simple manner.

Throughout this specification, the reference to lift arm apertures and corresponding trunnions mounted on the object or vessel is used herein for illustrative purposes only. The lift beam assembly according to the present invention can be used with any suitable coupling device. It is desirable, however, that the coupling device be of a type that can use the pivotal movement of the lift arms to accomplish the coupling process.

While a redundant lift beam assembly for lifting heavy objects has been shown and described in detail, it is obvious that this invention is not to be considered as being limited to the exact form disclosed and that changes in the detail and construction may be made therein within the scope of this invention, without departing from the spirit thereof.

What is claimed is:

1. A lift beam assembly for assisting in the lifting of heavy objects, the lift beam assembly comprising:

a. an elongated structural body having a means mounted near the midpoint of said body for engaging the hook of a lifting crane, b. a pair of lift arm means, one of said arm means being pivotally suspended at each end of said body, said arm means having a suspended end and the arm means is arranged so that the suspended end pivots outwardly in a longitudinal direction beyond the end of said body, a coupling means provided near the suspended end of each lift arm means, said coupling means being provided for connecting the lift arm means to a heavy object to be lifted, and c. latching mechanism means attached to each of said lift arm means whereby said lift arm means may be moved independently of the other lift arm means, said mechanism means having a pivotable lever attached at one end to said lift arm means and the opposite end attached to a slidable rod means whereby when said rod means is longitudinally moved the lift arm means pivots accordingly from a closed position where the coupling means connects said heavy object to an open position where said coupling means extends beyond and is free of said object, d. said latching mechanism means further including a releasable locking means, said locking means includes a key attached to said slide rod means and arranged so that said rod means can be held against longitudinal movement so that said lift arm means is locked either in said open or closed position.

2. A lift beam assembly as defined in claim 1 wherein said lift arm coupling means is a closed aperture formed in each of said lift arm means and sized to fit a lifting trunnion mounted on the outside surface of the object.

3. A lift beam assembly as defined in claim 2 which further includes a pair of guide means attached to said body means and extending downwardly therefrom, one of said guide means being located at each end of said body means in a position which is inward of and near to the corresponding lift arm means when in the closed position, said guide means being an elongated member having an open slot extending inwardly from a free end thereof, said slot being sized to receive a lifting trunnion on said object and positioned so that when the end of the guide means slot is in contact with the lifting trunnion the aperture in the corresponding lift arm means is properly located to engage or disengage the trunnion when moved to either the open position or closed position.

4. A lift beam assembly as defined in claim 1 which further includes guide means attached to said body means and arranged in cooperation with said lift arms whereby the coupling means on said lift arms are easily positioned and aligned for connecting with the object by properly positioning the body means.

5. A lift beam assembly as defined in claim 1 wherein said body means includes guard means which is disposed over and protects said latching mechanism so that said mechanism will not be accidentally moved or damaged during use.

6. A redundant lift beam assembly for lifting heavy objects which include at least four connectors spaced around the perimeter of said object, said redundant lift beam assembly comprising a plurality of lift beam assemblies arranged in crossed relationship to each other, each of said lift beam assemblies having a. an elongated body means having a crane attaching means provided near the mid-point of said body means, b. a pair of elongated lift arm means, a lift arm means being pivotally mounted at each end of said body means so that said lift arm means can be pivoted outwardly in a longitudinal direction from said body means, said arm means being capable of being moved from a closed position wherein a coupling means near the end of said lift arm means will engage a corresponding connector for lifting said object to an open position wherein said coupling means is extended outwardly beyond said connector, and c. mechanism means provided for each lift arm means, said mechanism means including an actuating means arranged so that movement of the actuating means will cause the mechanism means to pivot the lift arm means to and from said open and closed positions, d. said actuating means includes a slide rod means which causes the mechanism means to pivot, said actuating means further including a releasable locking means, said locking means includes a key attached to said slide rod means and arranged so that said slide rod means can be held against longitudinal movement so that said lift arm means is locked either in said open or closed position.

7. A redundant lift beam assembly as defined in claim 6 which further includes a crane hook means connected to a lifting crane, said hook means having a plurality of connecting means, each of said connecting means being disposed at an angle to the other and each is arranged to connect with a crane attaching means of one of said lift beam assemblies so that said lift beam assemblies are rigidly positioned in overlapping arrangement with respect to each other so that said redundant lift beam assembly can be positioned by the crane to straddle the object and attach the lift arm coupling means to the connectors so that said object may be safely lifted and moved by said crane.

8. A redundant lift beam assembly as defined in claim 7 wherein four of the connectors are equally spaced around the perimeter of the object, and two of said hook connecting means are arranged perpendicular to each other whereby their respective lift beam assemblies are positioned in symmetrical, perpendicular relation and the lift arm means are arranged to correspond to the equal spacing of the four connectors on the object.

9. A redundant lift beam assembly as defined in claim 6 wherein the lift arm coupling means is a closed aperture and the connectors on the object are lifting trunnions, the lift arm apertures being sized to easily engage the trunnions when the arms are moved from the open to the closed position.

10. A redundant lift beam assembly as defined in claim 6 wherein said crane attaching means for said lift beam assemblies include one or more pairs of oppositely aligned holes provided in said body means and one or more elongated pins arranged to be inserted through said holes, and bracket means mounted on the outer surface of said body means and aligned with said holes for supporting and storing said pins when not in use.

11. A redundant lift beam assembly as defined in clam 6 wherein said actuation means includes a tool having a connecting means at one end and an elongated handle at the other whereby the actuating means can be engaged by said connecting means from a remote position either above or below the lift beam assembly and said mechanism means operated for moving said lift arm means.

12. A lift beam latching mechanism for actuating the lift arm of a lift beam assembly for heavy objects, said lift beam assembly including an elongated body fabricated from a plurality of structural members joined together in a spaced arrangement and at least one lift arm pivotally mounted at one end of said body, said lift arm having a coupling means near the end opposite said body for engaging a connector on said heavy object, said latching mechanism comprising a. a right angle lever means pivotally mounted near the end of said body and having one end engaged with an end extension of said lift arm opposite said coupling means end, and b. an actuating rod means slidably mounted in a bore provided in said body, the opposite end of said right angle lever means being arranged to engage the slidable rod means, said rod means having a pair of spaced collars which receive and engage said right angle lever means causing it to move in response to longitudinal movements of said slide rod means whereby movement of said rod means will cause said lift arm to pivot from a closed lifting position where said lift arm is generally perpendicular to said body to an open position wherein the end of said lift arm is extended longitudinally outward beyond the end of said body.

13. A latching mechanism for lift beams as defined in claim 12 which further includes lock means having a key attached to and extending outwardly from said slide rod means and a slotted key way cooperating with the key and aligned with the bore for said slide rod means, said key and key way being provided for controlling the movement of said slide rod means whereby said lift arm can be locked in either said closed or open position.

14. A latching mechanism for lift beams as defined in claim 13 wherein said lock means includes spring biasing means provided in conjunction with said slide rod means for retaining said key in position with respect to said keyway when said lift arm is in the closed position to prevent movement of said latching mechanism and lift arm while lifting said heavy object.

15. A latching mechanism for lift beams as defined in claim 12 wherein rigid eyelet means is provided on at least one end of said slide rod means so that an operator can attach a tool to the eyelet means of said rod means for moving said slide rod means and actuating said lift arms from a generally remote location.

16. A lift beam latching mechanism as described in claim 12 which further includes guide means arranged to extend outwardly at right angles from said body and generally parallel to the lift arm whereby the body and lift arm can be properly positioned with respect to the heavy object, said guide means having an open ended slot at its free end so that when the slot engages the connector on the object the coupling means on the lift arm is properly aligned to engage the connector.

* * * * *